US009154870B2

(12) United States Patent
Watanabe

(10) Patent No.: US 9,154,870 B2
(45) Date of Patent: Oct. 6, 2015

(54) SOUND GENERATION DEVICE, SOUND GENERATION METHOD AND STORAGE MEDIUM STORING SOUND GENERATION PROGRAM

(71) Applicant: CASIO COMPUTER CO., LTD., Shibuya-ku, Tokyo (JP)

(72) Inventor: Kazuyoshi Watanabe, Tokyo (JP)

(73) Assignee: CASIO COMPUTER CO., LTD., Tokyo (JP)

( * ) Notice: Subject to any disclaimer, the term of this patent is extended or adjusted under 35 U.S.C. 154(b) by 291 days.

(21) Appl. No.: 13/796,911

(22) Filed: Mar. 12, 2013

(65) Prior Publication Data

US 2013/0243220 A1 Sep. 19, 2013

(30) Foreign Application Priority Data

Mar. 19, 2012 (JP) ..... 2012-061691

(51) Int. Cl.

| | |
|---|---|
| ***G10H 1/00*** | (2006.01) |
| ***H04R 3/00*** | (2006.01) |
| ***H04R 3/12*** | (2006.01) |
| *H04R 27/00* | (2006.01) |

(52) U.S. Cl.

CPC .. *H04R 3/00* (2013.01); *H04R 3/12* (2013.01); *H04R 27/00* (2013.01); *H04R 2227/003* (2013.01)

(58) Field of Classification Search

CPC .... H04R 2227/003; H04R 27/00; H04R 3/00; H04R 3/12

USPC ..... 381/73.1, 118

See application file for complete search history.

(56) References Cited

U.S. PATENT DOCUMENTS

| | | | | | |
|---|---|---|---|---|---|
| 5,619,582 | A | * | 4/1997 | Oltman et al. | 381/82 |
| 5,822,440 | A | * | 10/1998 | Oltman et al. | 381/82 |
| 6,130,949 | A | * | 10/2000 | Aoki et al. | 381/94.3 |
| 6,248,945 | B1 | * | 6/2001 | Sasaki | 84/604 |

(Continued)

FOREIGN PATENT DOCUMENTS

| | | | |
|---|---|---|---|
| JP | 07121161 | A | 5/1995 |
| JP | 08-241081 | A | 9/1996 |
| JP | 2009021888 | A | 1/2009 |

OTHER PUBLICATIONS

"Japanese Office Action dated Mar. 4, 2014 in counterpart Japanese Application No. 2012-061691".

*Primary Examiner* — Khai N Nguyen

(74) *Attorney, Agent, or Firm* — Holtz, Holtz, Goodman & Chick PC

(57) ABSTRACT

Disclosed is a sound generation device including a receiver which receives a sound emission instructing signal in which time data is included and a difference calculator which calculates a difference between a timing indicated in the received time data and a timing when the sound emission instructing signal is received by the receiver, when the sound emission instructing signal in which the time data is included is received. The sound generation device further includes a histogram creator which creates a histogram on the basis of the calculated difference and a difference calculated previously, when the difference is calculated and a timing controller which controls a timing for supplying the received sound emission instructing signal to a sound emission unit on the basis of the calculated difference and a most frequent difference in the created histogram, when the difference is calculated.

8 Claims, 10 Drawing Sheets

(56) References Cited

U.S. PATENT DOCUMENTS

| | | | | |
|---|---|---|---|---|
| 6,388,183 | B1 * | 5/2002 | Leh | 84/645 |
| 7,301,092 | B1 * | 11/2007 | McNally et al. | 84/612 |
| 7,995,770 | B1 * | 8/2011 | Simon | 381/82 |
| 8,234,395 | B2 * | 7/2012 | Millington | 709/231 |
| 2001/0043659 | A1 * | 11/2001 | Kurozumi et al. | 375/340 |
| 2005/0217462 | A1 * | 10/2005 | Thomson et al. | 84/612 |
| 2005/0226601 | A1 * | 10/2005 | Cohen et al. | 386/75 |
| 2008/0146329 | A1 * | 6/2008 | Kodama et al. | 463/31 |
| 2008/0267451 | A1 * | 10/2008 | Karazi | 382/103 |
| 2012/0024128 | A1 * | 2/2012 | Takahashi | 84/600 |
| 2012/0087507 | A1 * | 4/2012 | Meyer | 381/56 |
| 2012/0090448 | A1 * | 4/2012 | Yamanouchi | 84/723 |
| 2012/0108351 | A1 * | 5/2012 | Tamura | 473/213 |
| 2012/0111179 | A1 * | 5/2012 | Yamanouchi | 84/723 |

* cited by examiner

FIG. 8A NO DELAY ADJUSTMENT
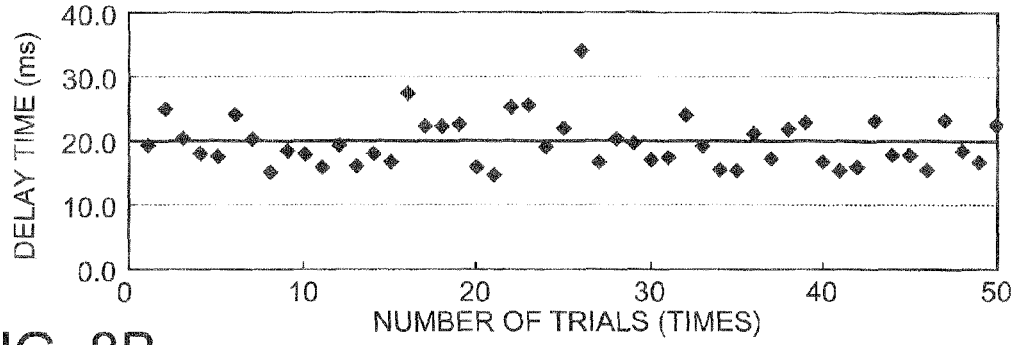
FIG. 8B 5ms DELAY ADJUSTMENT
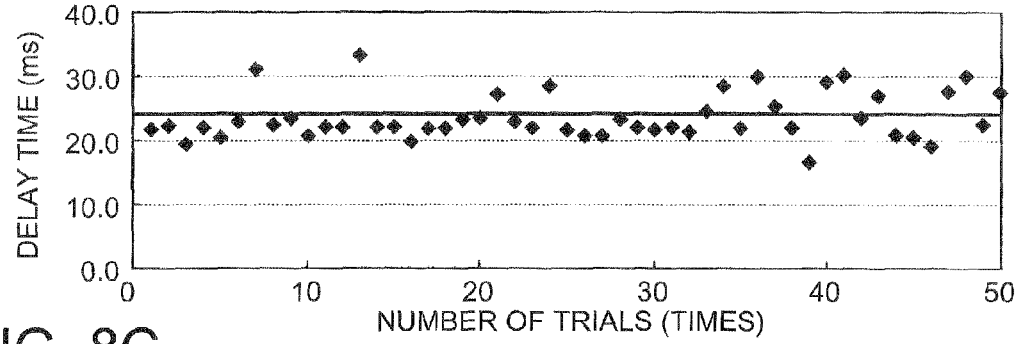
FIG. 8C 10ms DELAY ADJUSTMENT
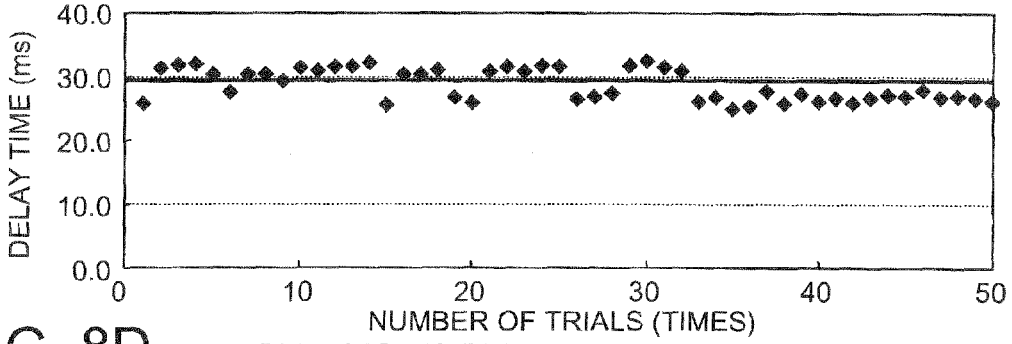
FIG. 8D 15ms DELAY ADJUSTMENT
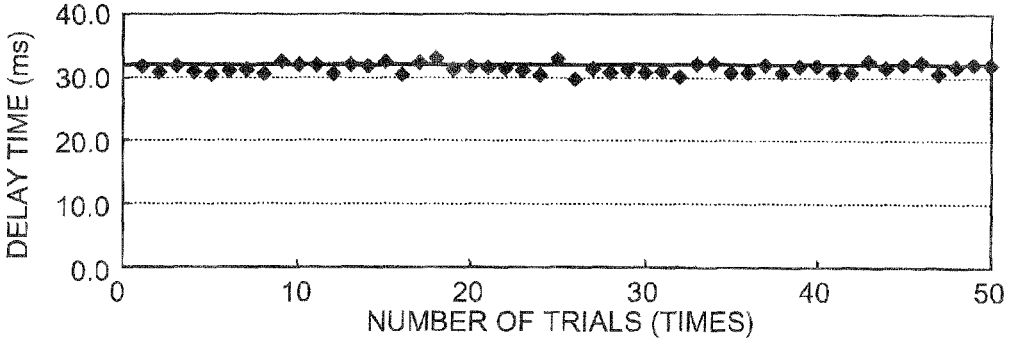

SOUND GENERATION DEVICE, SOUND GENERATION METHOD AND STORAGE MEDIUM STORING SOUND GENERATION PROGRAM

CROSS-REFERENCE TO RELATED APPLICATIONS

This application is based upon and claims the benefit of priority from the prior Japanese Patent Application No. 2012-061691, filed Mar. 19, 2012, and the entire contents of which are incorporated herein by reference.

BACKGROUND OF THE INVENTION

1. Field of the Invention

The present invention relates to a sound generation device, a sound generation method and a storage medium in which a sound generation program is stored.

2. Description of Prior Art

There is known a configuration where the performance operator with which a performer carries out operations is independent from the device equipped with the sound output unit such as a speaker, and signals giving instruction to emit predetermined sounds are sent to the device equipped with the sound output unit from the performance operating unit in a wireless manner (for example, see JP Hei08-241081).

If such configuration is to be applied to the device which allows to play an instrument virtually in a virtual space, the performance will be unnatural to the performer if the time lags until the actual sound emission from the operations for sound emission are too long or such time lags are not uniform.

Therefore, in order for a performer to enjoy the performance as an instrument, it is important to make the time lags until the actual sound emission from generating of the sound emission instructing signals be short as possible to stabilize the device.

In view of the above, JP Hei08-241081 discloses a computer music system connected with a plurality of sound sources wherein the transmission time period of the MIDI signals to the plurality of MIDI sound sources are measured in advance, the delay time by which the transmissions of MIDI signals to other MIDI sound sources are delayed according to the MIDI sound source having the maximum transmission time period is set and the MIDI signals are transmitted to the MIDI sound sources in a delayed fashion by the delay control to simultaneously emitting the sounds in the MIDI sound sources as a configuration for performing the plurality of sound sources simultaneously without a user of the computer music system noticing the time lags.

The transmission time periods of the MIDI signals to the plurality of the MIDI sound sources are predictable. Therefore, according to the method described in JP Hei08-241081, variation in the transmission time period of the MIDI signals can be revolved and the streaming reception can be stabilized.

However, the technique described in JP Hei08-241081 is for resolving the delays caused by external factors such as the transmission method in the data sending side and the like when transmitting the data and the sound emission (replay) timings depend on the timing in the device on the receiver side which is equipped with the sound output unit.

In such technique for resolving the delays, the sound emission timings being off can appropriately resolve in a case where there is no time lag (error) between the system timer in the performance operating unit and the system timer of the device equipped with the sound output unit. However, in reality, the technique described in JP Hei08-241081 could not resolve the time lags in a case where there is time lag (error) in the system timer in the device which performs the communication.

SUMMARY OF THE INVENTION

The present invention was made in view of the above problems and an object of the present invention is to provide a sound generation device by which a smooth performance can be carried out by preventing the sound emission timings from being off due to the time lag between the times in the sender side and the receiver side as much as possible in a case where sound emission instructing signals are sent to the device equipped with a sound output unit from a performance operating unit in a wireless manner, a sound generation method thereof and a storage medium in which a sound generation program is stored.

In order to solve the above problem, according to one aspect of the present invention, a sound generation device of the present invention includes a receiver which receives a sound emission instructing signal which includes time data, a difference calculator which calculates a difference between a timing indicated in the received time data and a timing when the receiver receives the sound emission instructing signal, when the sound emission instructing signal is received, a histogram creator which creates a histogram on the basis of the calculated difference and a difference calculated previously, when the difference is calculated; and a timing controller which controls a timing for supplying the received sound emission instructing signal to a sound emission unit which is connected to the timing controller on the basis of the calculated difference and a most frequent difference in the created histogram, when the difference is calculated.

According to another aspect of the present invention, a sound generation method of the present invention includes receiving a sound emission instructing signal which includes time data, calculating a difference between a timing indicated in the received time data and a timing when the sound emission instructing signal is received, when the sound emission instructing signal in which the time data is included is received, creating a histogram on the basis of the calculated difference and a difference calculated previously, when the difference is calculated and controlling a timing for supplying the received sound emission instructing signal to a sound emission unit on the basis of the calculated difference and a most frequent difference in the created histogram, when the difference is calculated.

According to another aspect of the present invention, a computer readable medium stores a sound generation program to make a computer execute receiving a sound emission instructing signal which includes time data, calculating a difference between a timing indicated in the received time data and a timing when the sound emission instructing signal is received, when the sound emission instructing signal in which the time data is included is received, creating a histogram on the basis of the calculated difference and a difference calculated previously, when the difference is calculated, and controlling a timing for supplying the received sound emission instructing signal to a sound emission unit the basis of the calculated difference and a most frequent difference in the created histogram when the difference is calculated.

BRIEF DESCRIPTION OF THE DRAWINGS

The above and other objects, advantages and features of the present invention will become more fully understood from the detailed description given herein below and the appended drawings which are given by way of illustration only, and thus are not intended as a definition of the limits of the present invention, and wherein:

FIG. 8A is a diagram showing a dispersion of sound emission timings in a case where a delay time adjustment is not performed;

FIG. 8B is a diagram showing a dispersion of sound emission timings in a case where a 5 ms delay time adjustment is performed;

FIG. 8C is a diagram showing a dispersion of sound emission timings in a case where a 10 ms delay time adjustment is performed;

FIG. 8D is a diagram showing a dispersion of sound emission timings in a case where a 15 ms delay time adjustment is performed;

DETAILED DESCRIPTION OF THE PREFERRED EMBODIMENT

Figure 1A:
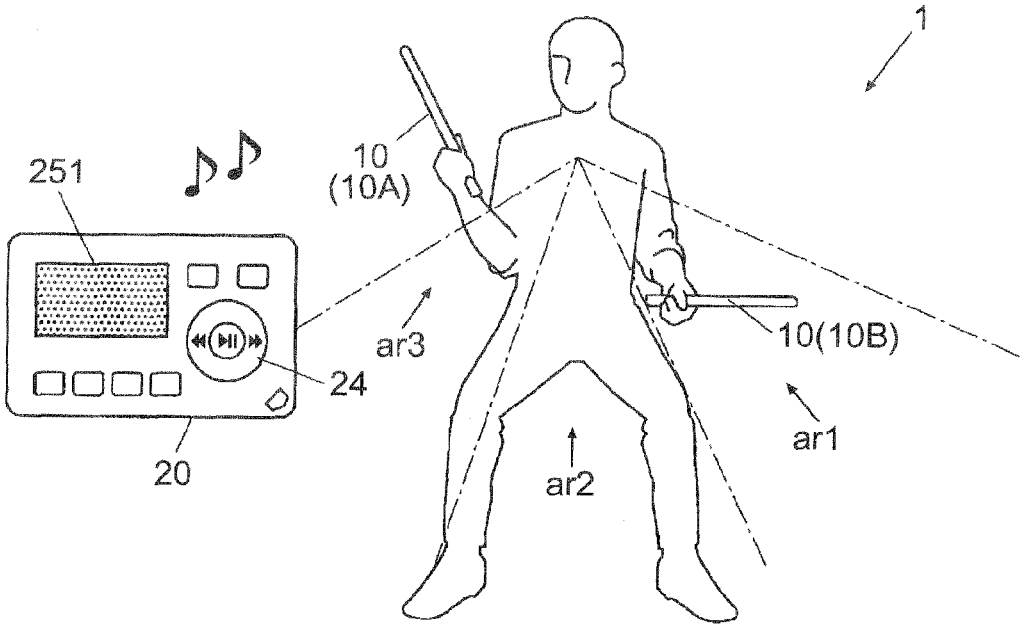
FIG. 1A is a diagram showing an outline of an embodiment of a sound generation device according to the present invention.

Hereinafter, embodiments of the present invention will be described by using FIGS. 1A to 10. Here, various limitations which are technically preferable for implementing the present invention are included in the following embodiments. However, they do not limit the scope of the invention to the following embodiments or the examples shown in the drawings.

[Outline of the Sound Generation Device]

First, the overall configuration of an embodiment of the sound generation device according to the present invention will be described with reference to FIGS. 1A and 1B.

Figure 1B:
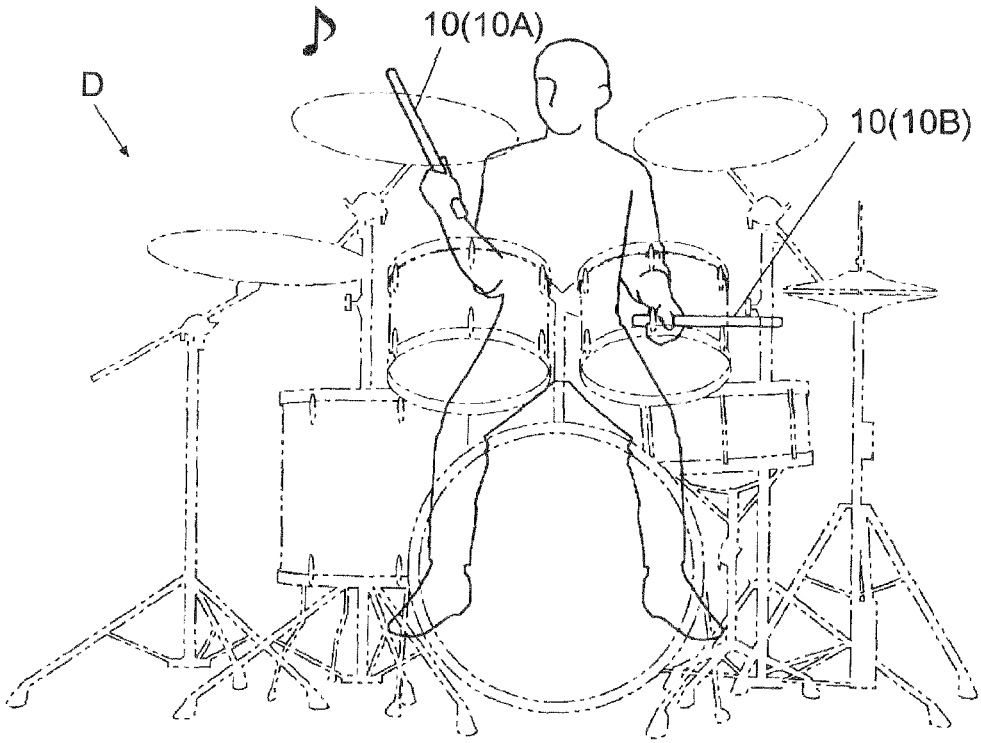
FIG. 1B is a diagram showing a virtual drum set of the embodiment.

FIG. 1A is a diagram showing an outline of a device configuration of the sound generation device according to the embodiment.

As shown in FIG. 1A, the sound generation device 1 of the embodiment includes stick units 10A and 10B and a center unit 20. Here, in order to realize a virtual drum performance using two sticks, the sound generation device 1 of the embodiment includes two stick units 10A and 10B. However, the number of stick units is not limited to the above and may be one stick unit or three or more stick units. Hereinafter, the stick units 10A and 10B are called "stick units 10" in cases where they need not be distinguished.

Each stick unit 10 includes a stick shaped performance operating unit main body which extends in a longitudinal direction and each stick unit 10 functions as a performance operating unit which can be held by a performer. That is, a performer holds one end (toward the base end) of the stick unit 10 and carries out a performance operation by swinging up and down the stick unit 10, his or her wrist or the like being the center.

To detect such performance operation of a performer, in the embodiment, various types of sensors (the after-mentioned motion sensor unit 14, see FIG. 2) such as an acceleration sensor are provided at the other end (toward to tip) of each stick unit 10.

Each stick unit 10 generates a sound emission instructing signal (note on event) to emit a predetermined sound from a sound output unit 251 such as a speaker, which is a sound generator, according to the detection results of the various types of sensors (the after-mentioned motion sensor unit 14) and outputs the generated sound emission instructing signal to the center unit 20 from the stick unit 10 with a time stamp, as time data, included therein.

The center unit 20 is a main device including the sound output unit 251 which is the sound generator which emits predetermined sounds on the basis of the movements of the stick unit 10 main bodies caused by an performer's operation.

In the embodiment, when the center unit 20 receives the sound emission instructing signal (note on event) from the stick unit 10, the center unit 20 calculates the time lag (difference) between the included time stamp and the time when the center unit 20 received the sound emission instructing signal and creates a histogram reflecting the differences. The center unit 20 performs the above processing when a sound emission instructing signal is received. Then, on the basis of the histogram, the center unit 20 adjusts the sound emission timings based on the sound emission instructing signals from the sound output unit 251.

[Configuration of the Sound Generation Device 1]

Hereinafter, the sound generation device 1 according to the embodiment will be described in detail.

Figure 2:
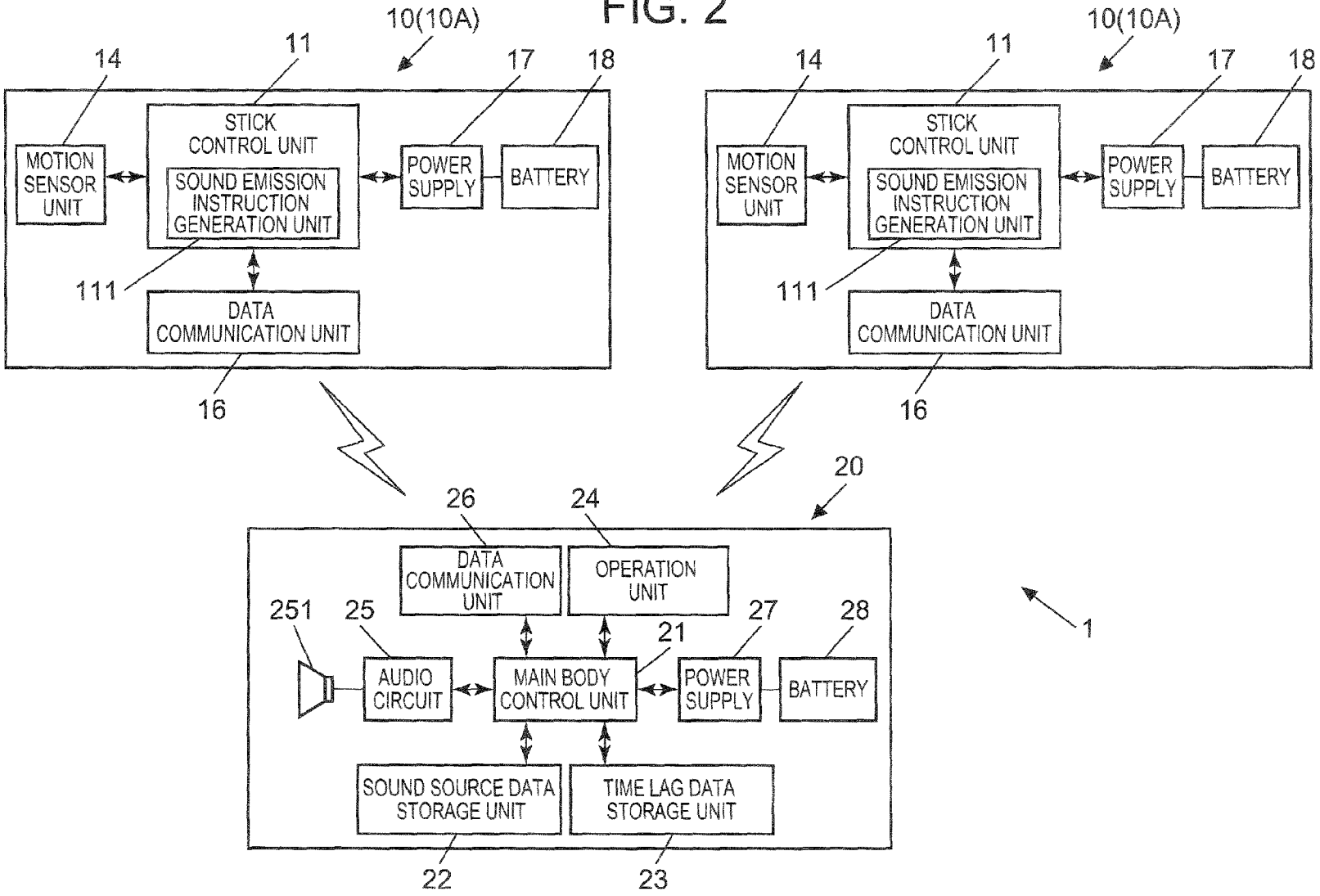
FIG. 2 is a block diagram showing a functional configuration of the sound generation device.

FIG. 2 is a block diagram showing a functional configuration of the sound generation device 1.

First, with reference to FIG. 2, configurations of the stick units 10 and the center unit 20 which constitute the sound generation device 1 will be described in detail.

[Configuration of the Stick Units 10]

As shown in FIG. 2, each stick unit 10 (each of the stick unit 10A and the stick unit 10B in FIG. 2) includes a stick control unit 11, a motion sensor unit 14, a data communication unit 16, a power supply 17, a battery 18 and the like.

The motion sensor unit 14 is a motion detection unit which detects moving of the stick unit 10 main body (performance operator) that occurs due to a performer's operation.

That is, the motion sensor unit 14 is provided inside each stick unit 10, for example, and the motion sensor unit 14 includes various types of sensors for detecting the conditions of the stick unit 10 (for example, swung down position, swinging down speed, swinging down angle and the like) and the motion sensor unit 14 outputs predetermined sensor values (motion sensor data) as detection results. The detection results (motion sensor data which is detected by the motion sensor 14 are sent to the stick control unit 11.

Here, as for the sensor constituting the motion sensor unit 14, an acceleration sensor, an angular velocity sensor, a magnet sensor and the like can be used.

As for the acceleration sensor, a biaxial sensor which outputs the accelerations occurred in two axial directions among X axis, Y axis and Z axis can be used. Here, regarding X axis, Y axis and Z axis, Y axis is the axis matches with the longitudinal axis of the stick unit 10, X axis is the axis which is parallel with the board (not shown in the drawing) on which the acceleration sensor is disposed and orthogonal to Y axis and Z axis is the axis which is orthogonal to X axis and Y axis. The acceleration sensor may obtain accelerations in components of X axis, Y axis and Z axis and also may calculate a sensor combined value which is the value all the accelerations are combined.

In the embodiment, when a performance is to be performed by using the sound generation device 1, a performer holds one ends (toward the base ends) of the stick units 10 and swings up and down the other ends (toward the tips) of the stick units 10, the wrists being the centers. Thereby, rotary movements occur in the stick units 10. Here, when the stick units 10 are still, the acceleration sensor in each stick unit 10 obtains the value corresponding to the gravitational acceleration 1 G as the sensor combined value. When the stick units 10 are performing the rotary movements, the acceleration sensor in each stick unit 10 obtains a value which is greater than the gravitational acceleration 1 G as the sensor combined value. Here, the sensor combined value can be obtained by calculating the square root of the sum of the squared values of the accelerations of the X axis, Y axis and Z axis components.

Figure 3:
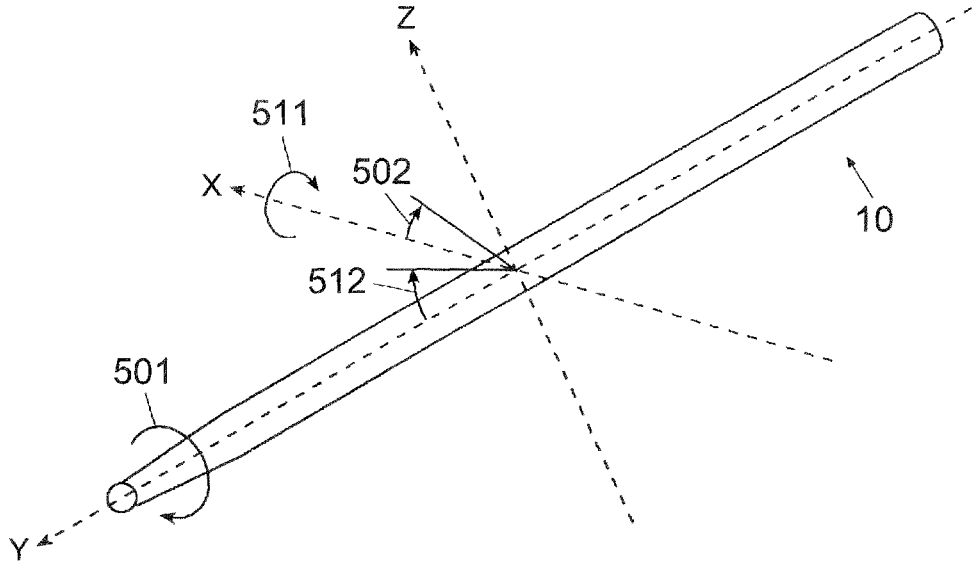
FIG. 3 is a schematic view of a stick unit shown in FIG. 1.

As for the angular velocity sensor, a sensor provided with a gyroscope can be used, for example. In the embodiment, the angular velocity sensor outputs the rotation angle 501 of each stick unit 10 in the Y axis direction and the rotation angle 511 of each stick unit 10 in the X axis direction as shown in FIG. 3.

Here, because the rotation angle 501 in the Y axis direction is the rotation angle of the axis in the front-back direction when seen from the performer when the performer is holding the stick unit 10, this rotation angle 501 in the Y axis direction can be called the roll angle. The roll angle corresponds to the angle 502 which indicates how much the X-Y plane is tilted with respect to the X-axis, and the roll angle occurs when a performer holds the stick unit 10 in her or his hand and rotates the stick unit 10 to the left and right on his or her wrist.

Further, because the rotation angle 511 in the X axis direction is the rotation angle of the axis in the left-right direction when seen from the performer when the performer is holding the stick unit 10, this rotation angle 511 in the X axis direction can be called the pitch angle. The pitch angle corresponds to the angle 512 which indicates how much the X-Y plane is tilted with respect to the Y axis, and the pitch angle occurs when a performer holds the stick unit 10 in her or his hand and swings his or her wrist in the up-down direction.

Although it is omitted in the drawings, the angular velocity sensor may also output the rotation angle in the Z axis direction. At this time, the rotation angle in the Z axis direction basically has the characteristics that are same as those of the rotation angle 511 in the X axis direction and is the pitch angle which occurs when a performer holds the stick unit 10 in her or his hand and swings her or his writs in the left-right direction.

As for the magnetic sensor, a sensor which can output the magnetic sensor values in two axis directions among the X axis, Y axis and Z axis shown in FIG. 3 can be used. From such magnetic sensor, the vector indicating north shown by a magnet (magnetic north) is output for each of the X axis, Y axis and Z axis. The output components in the axis directions are different according to the posture (orientation) of the stick unit 10. Therefore, the stick control unit 11 can calculate the roll angle, the rotation angles in the X axis direction and Y axis direction of the stick unit 10 from these components.

Next, detection results (motion sensor data) detected by the motion sensor unit 14 will be described with reference to FIG. 4. Here, the detection results of the acceleration sensor among the various types of sensors are shown.

In a case where a performer is to perform by using the stick units 10, the performer generally carries out the movements similar to the actual movements of hitting an instrument (for example, drums). In such movements (performance), a performer first swings up the stick units 10 and swings down the stick units 10 toward the hitting surface (performance surface) of the virtual instrument. Then, because the hitting surface does not actually exist, the performer uses his or her force and tries to stop the movements of the stick units 10 just before the stick units 10 hit the virtual instrument.

Figure 4:
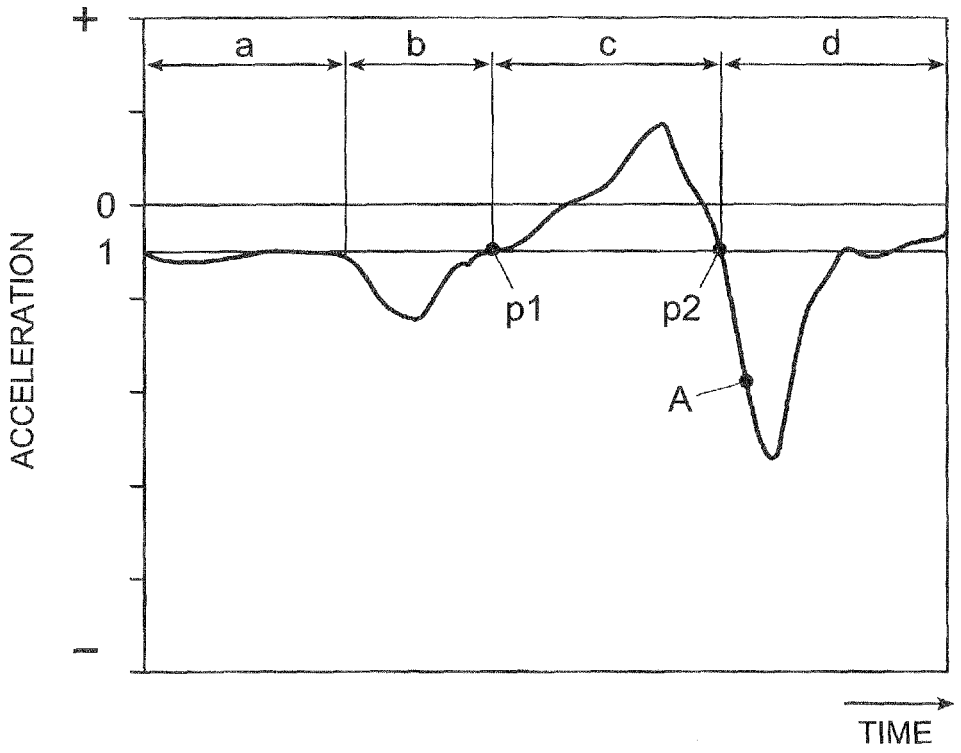
FIG. 4 is a diagram showing changing in acceleration of the motion sensor unit in a vertical direction.

FIG. 4 is a diagram expressing changing in acceleration of the motion sensor unit 14 in vertical direction in a case where a performance operation is carried out by using the stick units 10, and FIG. 4 shows an example of motion sensor data which is sent to the center unit 20 from each of stick units 10.

The acceleration in vertical direction means acceleration in vertical direction with respect to a horizontal plane, and the acceleration in vertical direction can be calculated from the acceleration of the Y axis component by degrading or can be calculated from the acceleration in the Z axis direction (the acceleration in the X axis direction according to the roll angle) by degrading. In FIG. 4, minus acceleration indicates acceleration in downward direction added to the stick unit 10 and plus acceleration indicates acceleration in upward direction added to the stick unit 10.

Even when the stick units 10 are still (the range indicated with "a" in FIG. 4), because the gravitational acceleration is applied to the stick units 10, the motion sensor unit 14 of each stick unit 10 is maintained still against the gravitational acceleration and such motion sensor unit 14 detects a certain acceleration in the vertical downward direction, that is, in the minus direction. Here, the acceleration applied to the stick unit 10 becomes 0 when the stick unit 10 is freely falling.

Next, when a performer holds up the stick unit 10 according to his or her swinging up movement in the state where the stick unit 10 is still as shown in the range indicated with "b" in FIG. 4, because the stick unit 10 moves in the direction even more against the gravitational acceleration, the acceleration applied to the stick unit 10 increases in the minus direction. Thereafter, when the acceleration in swinging up movement is decreased due to the performer trying to hold the stick unit 10 still, the acceleration switches to the plus direction from the minus direction, and the acceleration at the point where the swinging up movement reached the maximum velocity (see "p1" in FIG. 4) is only the gravitational acceleration (i.e. gravitational acceleration 1 G).

Next, when the stick unit 10 reaches the height due to the swinging up movement as in the range indicated with "c" in FIG. 4, a performer carries out the swinging down movement of the stick unit 10. Because the stick unit 10 moves in the direction complying with the gravitational acceleration in the swinging down movement, the acceleration applied to the stick unit 10 increases in the plus direction beyond the gravitational acceleration. Thereafter, when the swinging down movement reaches the maximum velocity, the stick unit 10 is to be in the state where only the gravitational acceleration (i.e. gravitational acceleration 1 G) is applied thereto again (see "p2" in FIG. 4).

Thereafter, as shown in the range indicated with "d" in FIG. 4, when the swinging up movement of the stick unit 10 is performed again, the acceleration applied to the stick unit 10 increases in the minus direction, and the acceleration applied to the stick unit 10 switches to the plus direction from the minus direction when the performer tries to stop the swinging up movement and hold the stick unit 10 still.

During when the performance operation continues, the changing of the acceleration as shown in FIG. 4 is repeated according to the swinging up and swinging down movements of the stick unit 10 performed by a performer. The changing of the acceleration is detected by the motion sensor unit 14.

The stick control unit 11 is configured as a MCU (Micro Control Unit) and the like, for example. The stick control unit 11 is an integrated circuit wherein a CPU (Central Processing Unit), a memory such as ROM (Read Only Memory) or the like, a timer (system timer) as a time counting unit and such like are included. Here, the configuration of the functional units which controls the entire center unit 20 is not limited to what is exemplified here. For example, the stick control unit 11 may have the CPU, the ROM, the timer and the like mounted on a board individually, not having the configuration as a MCU.

In the memory of the stick control unit 11, processing programs of various types of processes which are executed by the stick control unit 11 are stored.

The stick control unit 11 is for executing the control of the entire stick units 10. The various types of functions of the stick control unit 11 are realized by the CPU cooperating with the programs stored in the memory.

In the embodiment, the stick control unit 11 of each stick unit 10 includes the sound emission instruction generation unit 111 which generates sound emission instructing signals (note on event) on the basis of the detection results obtained by the motion sensor unit 14.

The sound generation instruction generation unit 11 generates a sound emission instructing signal (note on event) corresponding to the detection results (motion sensor data) relating to the position and movement of each stick unit 10 (performance operator) detected by the motion sensor unit 14, which is a detection unit, when a performer carries out a performance operation by using the stick units 10 (performance operators).

Here, a sound generation instructing signal (note on event) includes information such as a shot timing (sound emission timing), a sound volume (i.e. sound intensity (velocity)), a sound tone (i.e. a type of instrument).

The sound emission instructing signal (note on event) which is generated by the sound emission instruction generation unit 11 is output to the center unit 20, and the main body control unit 21 of the center unit 20 emits a sound from the sound output unit 251 such as a speaker on the basis of the sound emission instructing signal (note on event).

In particular, first, after the detection results (motion sensor data) relating to the positions and movements of the stick unit 10 (performance operator) detected by the motion sensor unit 14 are obtained, the sound emission instruction generation unit 11 detects the timings (shot timings) to hit the virtual instrument with the stick unit 10 on the basis of the accelerations (or the sensor combined value) output from the acceleration sensor.

Next, detection of shot timings performed by the sound emission instruction generation unit 111 will be described with reference to FIG. 4.

As described earlier, FIG. 4 is a diagram showing the changing of acceleration of the motion sensor unit 14 in the vertical direction in a case where a performance operation is carried out by using the stick units 10.

A performer expects that a sound is to be emitted at the moment he or she hits the stick unit 10 on the virtual instrument. Therefore, it is preferable that a sound can be emitted at the timing the performer expects the sound also in the sound generation device 1. In view of the above, a sound is emitted right at the moment when a performer hits the hitting surface of the virtual instrument with the stick unit 10 or just before that in the embodiment.

That is, in the embodiment, the sound emission instruction generation unit 111 detects the moment the swinging up movement starts after the swinging down movement as the moment the performer hits the hitting surface of the virtual instrument with the stick unit 10. In particular, the sound emission instruction generation unit 111 detects the point A in the range indicated with "d" in FIG. 4 where the acceleration further increases in the minus direction for a predetermined value from the state where the stick unit 10 is still, that is, from the point where the applied acceleration is only the gravitational acceleration (see "p2" ins FIG. 4) as the shot timing (sound emission timing).

Then, the sound emission instruction generation unit 111 generates a sound emission signal (note on event) so as to emit a sound at the time when the shot timing is detected.

Moreover, the sound emission instruction generation unit 111 detects the velocity and intensity of the swinging down movement of the stick unit 10 (performance operator) performed by a performer and the positions and angle of the stick unit 10 which is swung down and the like on the basis of the detection results (motion sensor data) relating to the movement of the stick unit 10 detected by the motion sensor unit 14. In particular, the sound emission instruction generation unit 111 determines that in which position among the performance areas ar1 to ar3 the stick unit 10 was swung down from the detection results of the magnetic sensor and the like, for example, and further determines the intensity and the like of the hit from the acceleration in the swinging down movement and the like on the basis of the detection results of the acceleration sensor and the like.

In the embodiment, the position coordinate data of the virtual drum set D (see FIG. 1B) is stored in the storage unit such as a ROM or the like (not shown in the drawing) of the stick control unit 11 with the performance areas distinguished in the motion sensor unit 14 associated thereto.

The number of performance areas which can be distinguished in the motion sensor unit 14 and the number of types of instruments to be associated are not specifically limited. However, in the embodiment, the space in front of a performer is divided into three areas virtually and the performance areas ar1 to ar3 (see FIG. 1A) are set as shown in FIG. 1A. Then, for example, the percussion instruments which constitute the virtual drum set D (see FIG. 1A) assumed in the embodiment are stored in the storage unit such as a ROM with the position coordinates of the performance areas ar1 to as3 of the instruments in the space associated thereto. For example, "high-hat" is associated with the performance area ar1, "snare drum" is associated with the performance area ar2 and "Floor Tam" is associated with the performance area ar3.

The types of instruments which are to be associated with the performance areas ar1 to ar3 are not limited to the above examples. It may be configured that a performer can change and set the types of instruments which are to be associated with the performance areas ar1 to ar3 ex post facto.

Then, the sound emission instruction generation unit 111 specifies the instrument the stick unit 10 hit on the basis of the position coordinate data which is specified from the position coordinate data of the virtual drum set D and the detection results of the motion sensor unit 14 (for example, the orientation detected by the magnetic sensor or the like), and the sound emission instruction generation unit 111 determines at what speed, intensity, timing and the like the relevant instrument was hit and generates a sound emission instructing signal (note on event) which instructs to emit a predetermined sound at the volume corresponding to the speed and intensity of the hit and at a predetermined shot timing on the basis of the determination result. The sound emission instructing signal (note on event) which is generated in the sound emission instruction generation unit 111 is made to be associated with identification information (stick identification information) which allows distinguishing between the stick unit 10A and the stick unit 10B and is output to the center unit 20 with a time stamp as time data which indicates the time when the sound emission instructing signal is sent.

Figure 5A:
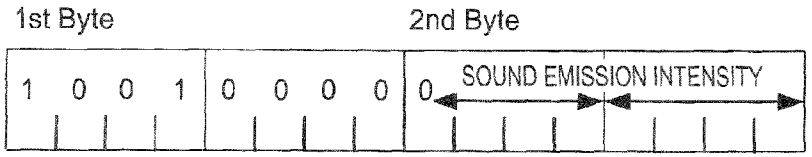
FIG. 5A is a diagram showing a configuration example of a sound emission instructing signal without a time stamp.
Figure 5B:
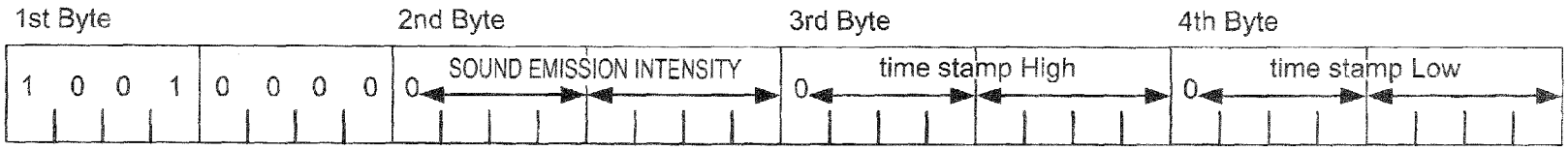
FIG. 5B is a diagram showing a configuration example of a sound emission instructing signal with a time stamp.

FIG. 5A shows a configuration example of a sound generation instructing signal without a time stamp and FIG. 5B shows a configuration example of a sound generation instructing signal with a time stamp.

As shown in FIG. 5A, in a case where a time stamp is not included in a sound emission instructing signal (note on event), data indicating the tone (i.e. the type of sound indicating which instrument the sound belongs to) and the timing of the shot is assigned to the $1^{st}$ Byte section and data on sound emission intensity (velocity) indicating the volume is assigned to the $2^{nd}$ Byte section.

Further, as shown in FIG. 5B, in a case where time stamps are included in a sound emission instructing signal (note on event), similarly to the case where a time stamp is not included, data for deciding the content of sound emission itself such as the tone, volume (sound emission intensity (velocity)), shot timing and the like is assigned to the $1^{st}$ Byte section and the $2^{nd}$ Byte section and data on time stamps is assigned to the 3rd Byte section and the 4th Byte section, the $3^{rd}$ Byte section and the 4th Byte section make 14 bits.

Going back to FIG. 2, the data communication unit 16 performs a predetermined wireless communication with at least the center unit 20. The predetermined wireless communication may be performed in other arbitrary methods. In the embodiment, the wireless communication is performed between the data communication unit 16 and the center unit 20 through an infrared data communication. Here, the wireless communication method used by the data communication unit 16 is not specifically limited.

In the embodiment, the data communication unit 16 functions as the communication unit of the operator which includes time data in a sound emission instructing signal generated by the sound emission instruction generation unit 111 and which sends the signal to the center unit 20 which is the main device through the wireless communication.

Further, a battery 18 is built-in in each stick unit 10. The battery 18 supplies electric power to the operation units in each stick unit 10 through the power supply 17.

The battery 18 may be a primary battery or a secondary battery which can be charged. It is not required that the battery 18 is built-in and the configuration may be such that power is supplied from outside through a cable or the like.

[Configuration of the Center Unit 20]

As shown in FIG. 2, the center unit 20 includes a main body control unit 21, a sound source data storage unit 22, a time lag data storage unit 23, an operation unit 24, an audio circuit 25, a sound output unit 251, a data communication unit 26, a power supply 27, a battery 28 and the like.

In the sound source data storage unit 22, waveform data of various types of sound tones (i.e. sound source data of various instruments) is stored. For example, waveform data of the percussion instruments constituting the virtual drum set D (see FIG. 1B) assumed in the embodiment, such as a bass drum, a high-hat, a snare drum, a Floor Tom, cymbals and the like, is stored in the sound source data storage unit 22. In the embodiment, the waveform data on sound tones stored in the sound source data storage unit 22 is not limited to the above percussion instruments, and waveform data of sound tones of wind instruments such as flute, sax and trumpet, keyboard instruments such as piano and string instruments such as guitar may be stored in the sound source data storage unit 22, for example.

In the time lag data storage unit 23, a region as a time buffer in which a time lag (difference, error) between the time indicated by the timer (the time indicated by the system timer) of the main body control unit 21 in the center unit 20 and the time stamp itself included in the sound emission instructing signal or the time indicated in the time data (time stamp), which is calculated in the main body control unit 21, included in the sound emission instructing signal (note on event) is stored, a region in which histogram data of the time lags is stored and the like are provided. In the embodiment, the time buffer always stores the most recent 100 data, and the content of the stored data dynamically changes in such way that when new data (time stamp or time lag data) is obtained, the oldest data in the stored data is deleted to be replaced by the new data.

In the embodiment, the time lag between the time stamp included in a sound emission instructing signal and the time indicated by the system timer in the center unit 20 is calculated when a sound emission instructing signal (note on event) is obtained, and the calculated time lag is to be stored in the time lag data storage unit 23 in order.

The main body control unit 21 is configured in a MCU (Micro Control Unit) or the like, for example, and is a unit wherein a CPU (Central Processing Unit), a memory such as a ROM (Read Only Memory), a timer (system timer) as a time counting unit and the like are included in one integrated circuit.

The main body control unit 21 executes the controlling of the entire center unit 20. Various types of functions of the main body control unit 21 are realized by the CPU cooperating with the programs stored in the memory. Here, the configuration of the functional units which perform the controlling of the entire center unit 20 is not limited to the above example. In stead of being configured as MCU, a CPU, a ROM, a timer and the like may be mounted on a board or the like individually, for example.

In the memory of the main body control unit 21, processing programs of various types of processes which are executed by the main body control unit 21 are stored. Further, in the memory, identification information (stick identification information) which allows distinguishing between the stick unit 10A and the stick unit 10B is stored. The main body control unit 21 checks the stick identification information included in the information sent from each of the stick units 10A and 10B against the stick identification information stored in the memory, and thereby, the stick unit 10A or 10B which is the sender of the information (signal) can be specified.

Moreover, in the embodiment, the main body control unit 21 functions as the sound emission timing adjustment unit which calculates the difference between the time indicated by the time data (time stamp) included in a sound emission instructing signal (note on event) and the time when the data communication unit 26, which is the main body communication unit, received the sound emission instructing signal and creates the histogram reflecting the difference, the main body control unit 21 performing this processing when a sound emission instructing signal is received, and adjusts the sound emission timing based on the sound emission instructing signal from the sound output unit 251 as the sound emission unit on the basis of the histogram.

Figure 6A:
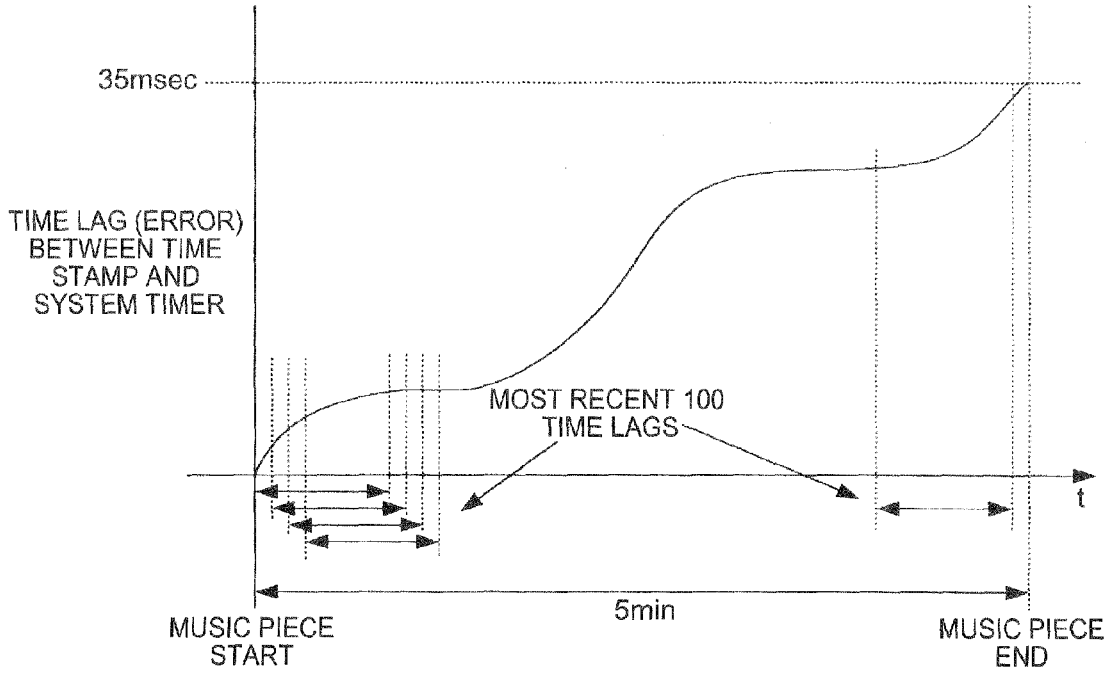
FIG. 6A is an example of a graph showing time lags (error) between the time stamp and the system timer.

FIG. 6A is a graph showing the differences (time lag, error) between the times indicated in the time data (time stamp)

included in the sound emission instructing signals (note on event) and the times when the data communication unit 26 of the center unit 20 received the sound emission instructing signals.

In the embodiment, the stick control unit 11 of each stick unit 10 includes an independent oscillator which becomes the clock input of the system timer. Similarly, the main body control unit 21 of the center unit 20 also includes an independent oscillator which becomes the clock input of the system timer. Therefore, inevitable lag (error) exists between the system timer of each stick unit 10 which is the signal sender and the system timer of the center unit 20 which is the signal receiver.

For example, in a case where the system timer exhibiting 5 second time lag per day is used in both the stick control unit 11 which is the sender and the main body control unit 21 which is the receiver, there will be 10 second error at most in 24 hours between the stick control unit 11 which is the sender and the main body control unit 21 which is the receiver. This means that there will be 35 msec lag in 5 minutes, 5 minutes generally being approximately the length of a music piece. Generally, if there is a time lag of 10 seconds or more, a person will notice such time lag. Therefore, if 35 msec time lag exists in 5 minutes, this time lag cannot be ignored with respect in an instrument performance.

As shown in FIG. 6A, the time lag (error) that exists between the system timer in the stick control unit 11 which is the sender and the system timer in the main body control unit 21 which is the receiver changes so as to increase in an almost linear manner.

In such way, in a case where there is a time lag between the system clocks in the sender side and the receiver side, the time lag (error) reappears as the time elapses even when they are matched by some sort of method.

In the embodiment, the main body control unit 21 calculates the difference (time lag, error) between the time indicated in the time data (time stamp) which is included in a sound emission instructing signal (note on event) and the time when the data communication unit 26, which is the main body communication unit, receives the sound emission instructing signal and creates the histogram reflecting the difference (time lag), the main body control unit 21 performs this processing when a sound emission instructing signal is received.

The time stamp data in a sound emission instructing signal which is newly obtained and the time lag data which is newly calculated are stored in the time buffer in the time lag data storage unit 23.

Figure 6B:
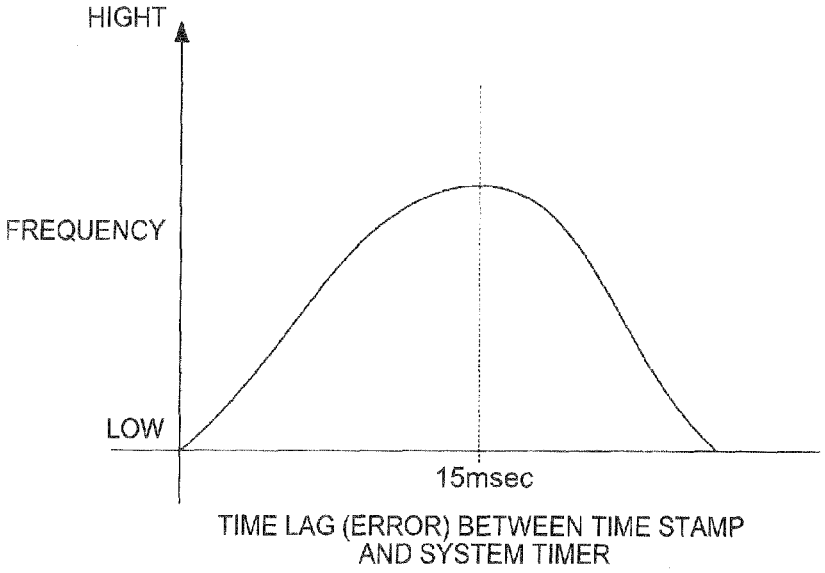
FIG. 6B is an example of a histogram based on the most recent 100 time lag data shown in FIG. 6A.

FIG. 6B shows an example of the histogram of time lags which is created in the main body control unit 21.

In the histogram shown in FIG. 6B, it is shown that the 15 msec time lag most frequently occurs as the time lag (error) between the time indicated by the time stamp and the time indicated by the system timer in the main body control unit 21.

In the embodiment, the main body control unit 21 creates the histogram on the basis of the most recent 100 time lag data as shown in FIG. 6A. When the main body control unit 21 newly receives a sound emission instructing signal (note on event) and obtains the time stamp thereof, the main body control unit 21 calculates the time lag (error) between the time indicated by the time stamp in the sound emission instructing signal and the time indicated by the system timer in the main body control unit 21. When the main body control unit 21 newly obtains time lag data, the main body control unit 21 deletes the oldest data in the time lag data stored in the time buffer, subtracts the oldest data constituting the histogram and stores the newly obtained time lag data in place of the oldest data. Then, the main body control unit 21 creates (updates) the histogram on the basis of the updated time lag data.

Here, the number of time lag data to be used for creating the histogram is not limited to 100, and the histogram can be created on the basis of even greater number of data.

The main body control unit 21 adjusts the sound emission timing based on the sound emission instructing signal to emit a sound from the sound output unit 251, which is the sound emission unit, on the basis of the histogram.

In the embodiment, the main body control unit 21 adjusts the sound emission timing also by taking the delays in the communication time caused by external factors due to communication condition, communication method and the like into consideration.

Figure 7:
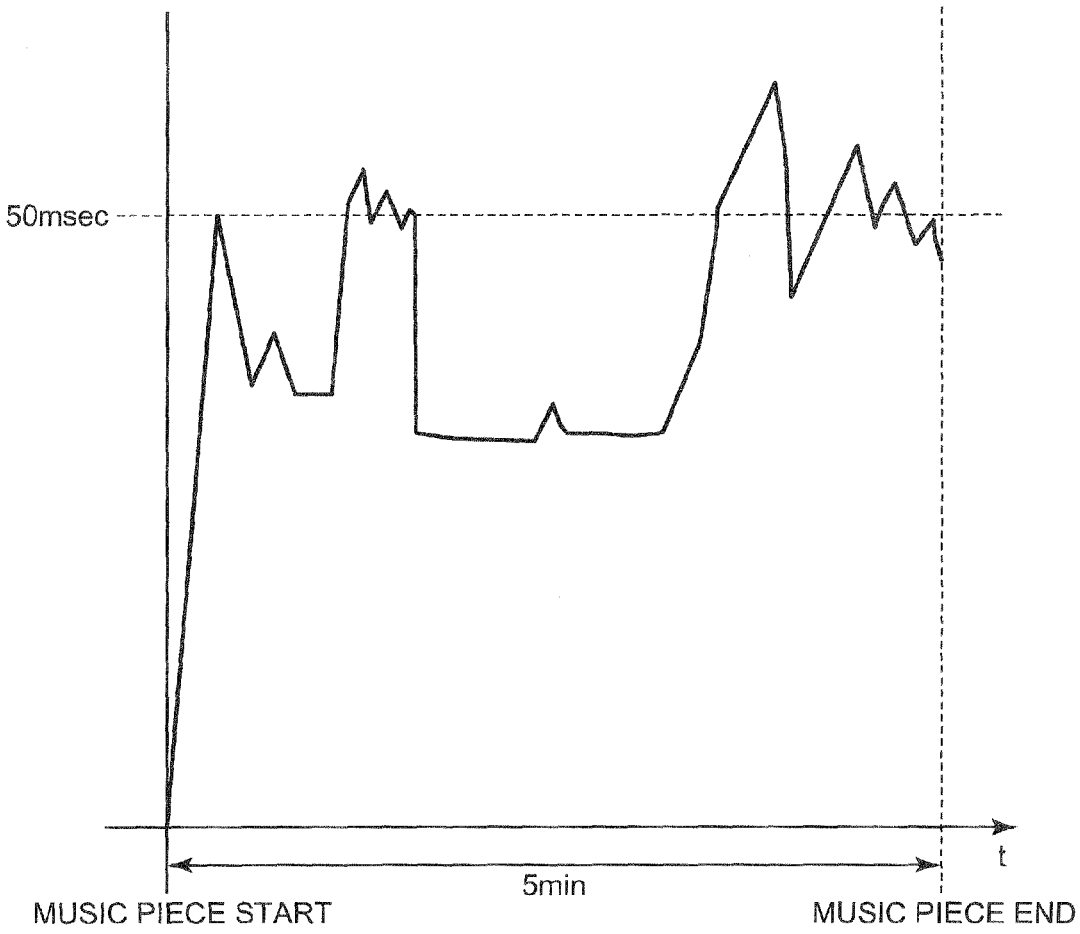
FIG. 7 is a graph showing a dispersion example of delays caused by external factors.

FIG. 7 is a graph showing an example of the delays in communication time caused by external factors due to communication condition, communication method and the like. Similarly to FIG. 6A, FIG. 7 is a graph in which delays in communication time that occur in 5 minutes, 5 minutes generally being the length of one music piece, are shown according to the time axis.

As shown in FIG. 7, the delays in communication time caused by external factors do not necessarily increase in a linear manner and they occur in arbitrary lengths.

In the actual sending and receiving of a signal, the lag caused by the time lag between the system timers in the sender side and the receiver side shown in FIG. 6A and the delay in communication time caused by an external factor such as the communication method shown in FIG. 7 are combined to be the overall lag in communication time.

The delays in communication time caused by external factors shown in FIG. 7 can be dealt with by obtaining the frequency and the average value, for example.

In the embodiment, the main body control unit 21 calculates the frequency of the delays in communication time caused by external factors in a certain time period and takes the calculate frequency into consideration in the after-mentioned sound emission timing adjustment processing, the frequency being the "specified time" (see FIG. 9) which is the set delay.

FIGS. 8A to 8D are graphs showing dispersions of sound emission timings in a case where the sound emission timing adjustment processing is not performed by the main body control unit 21 and in cases where the sound emission timing adjustment processing is performed by the main body control unit 21.

FIG. 8A is a case where any type of adjustment was not performed. In FIG. 8A, the sound emission timings are greatly dispersed. FIG. 8B is a case where the 5 ms delay adjustment was performed, FIG. 8C is a case where the 10 ms delay adjustment was performed and FIG. 8D is a case where the 15 ms delay adjustment was performed. As the delay adjustment time becomes longer, the overall time is delayed. However, by delaying as a whole according to the delayed sounds, the dispersion of the sound emission timings can be improved greatly and the time lag is to be within the range that a person cannot notice in his or her ears.

Going back to FIG. 2, the operation unit 24 receives input information based on input operations performed by a performer or the like. Input information includes changes in volume of the sound to be emitted and in tone of the sound to be emitted, instructions for starting and ending the performance operation and the like, for example.

Further, the center unit 20 includes a sound output unit 251 formed of the audio circuit 32, a speaker and the like.

To the audio circuit 32, sound data based on a sound emission instructing signal is to be output from the main body control unit 21. The audio circuit 32 converts the sound data output from the main body control unit 21 to an analog signal, amplifies the converted analog signal and outputs the analog signal to the sound output unit 251.

The sound output unit 251 is a speaker, for example, and the sound output unit 251 is the sound emission unit which emits the sounds based on the sound data generated in the main body control unit 21. The sound output unit 251 outputs a predetermined sound, on the basis of a sound emission instructing signal, at the timing which is adjusted by the main body control unit 21 as the sound emission timing adjustment unit.

The sound output unit 251 is not limited to a speaker and may be an output terminal which outputs sounds such as a headphone, for example.

The data communication unit 26 performs a predetermined wireless communication at least with the stick units 10. The predetermined wireless communication may be performed in an arbitrary method. In the embodiment, the wireless communication is performed between the data communication unit 26 and the stick units 10 through an infrared data communication. Here, the method of wireless communication performed by the data communication unit 26 is not specifically limited.

In the embodiment, the data communication unit 26 functions are the main body communication unit which receives sound emission instructing signals in which time data is included from the stick units 10 which are the performance operators in a wireless manner.

A battery 28 is built-in in the center unit 20, and the battery 28 supplies electric power to the operation units in the center unit 20 through the power supply 27.

The battery 28 may be a primary battery or a secondary battery which can be charged. It is not required that the battery 28 is built-in and the configuration may be such that power is supplied from outside through a cable or the like.

[Processing in the Sound Generation Device 1]

Next, the processing performed in the sound generation device 1 will be described with reference to FIGS. 9 and 10.

Figure 9:
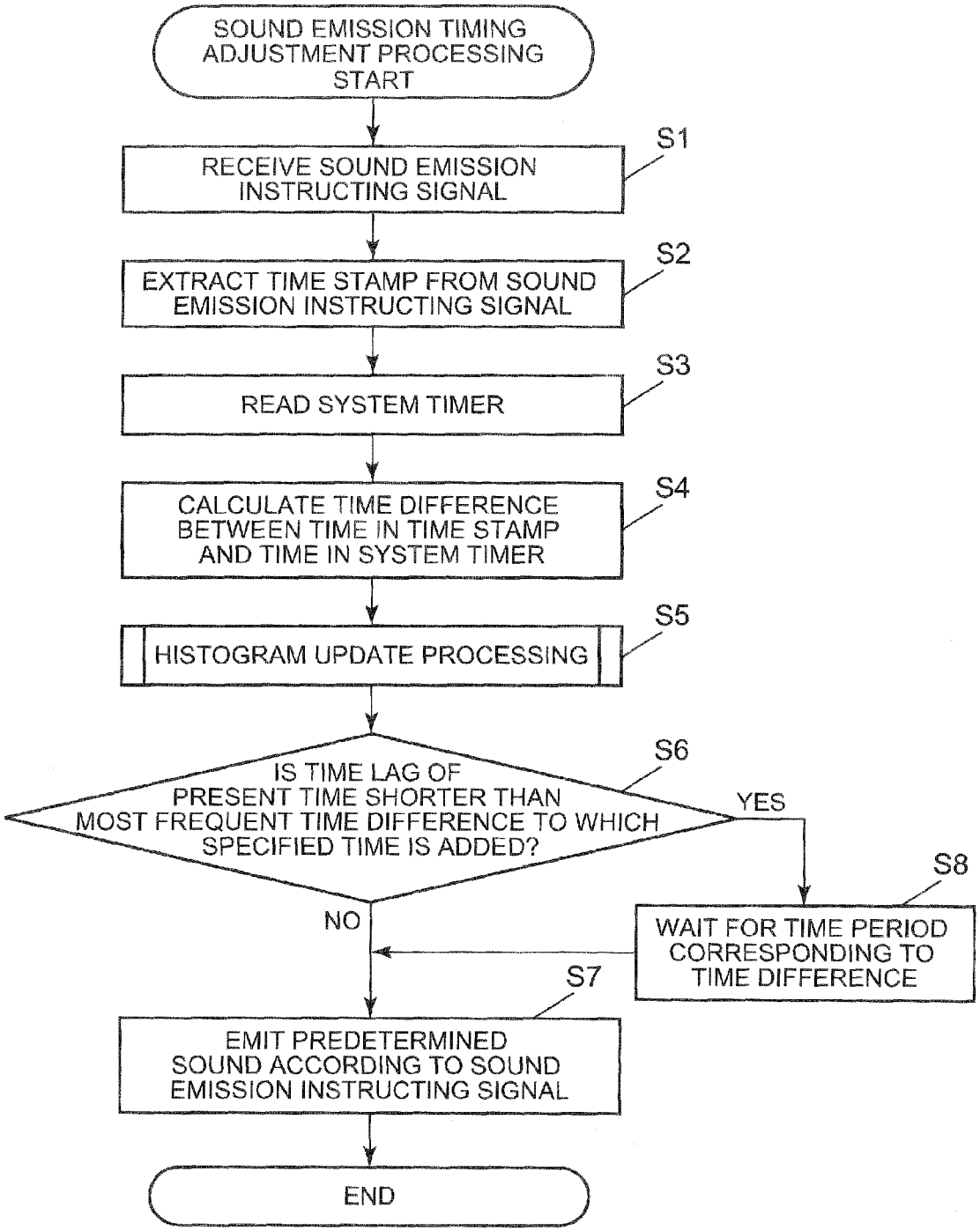
FIG. 9 is a flowchart showing sound emission control processing.
Figure 10:
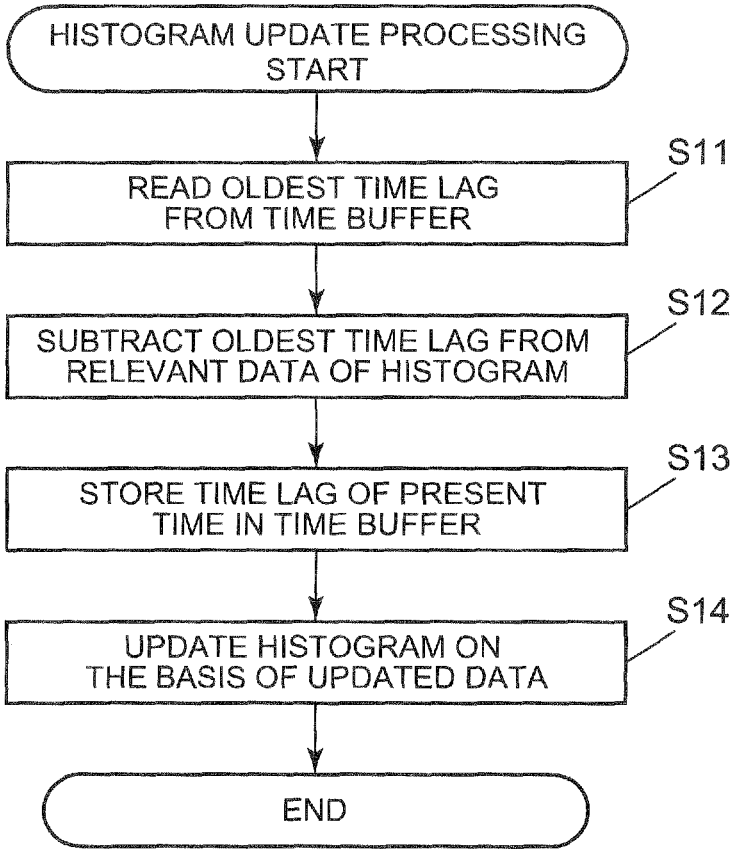
FIG. 10 is a flowchart showing histogram update processing indicated in FIG. 9.

FIG. 9 is a flowchart showing the sound emission timing adjustment processing and FIG. 10 is a flowchart showing the histogram update processing.

As shown in FIG. 9, if the main body control unit 21 in the center unit 20 receives a sound emission instructing signal (note on event) from the stick unit 10 (step S1), the main body control unit 21 extracts the time stamp which is the time data from the sound emission instructing signal (note on event) (step S2).

After the main body control unit 21 extracts the time stamp, the main body control unit 21 reads the system timer (step S3) and calculates the time lag between the time indicated by the time stamp and the time indicated by the system timer (step S4). The calculated time lag data is stored in the time buffer. After the time lag between the system timers in the stick unit 10 (i.e. in the sender side) and in the center unit 20 (i.e. in the receiver side), the main body control unit 21 performs update processing of the histogram (step S5).

FIG. 10 shows the histogram update processing performed by the main body control unit 21.

In the embodiment, if a time lag is newly calculated, the main body control unit 21 reads the oldest time lag data in the time lag data stored in the time buffer of the time lag data storage unit 23 from the time buffer (step S11) and subtracts the oldest time lag data from the relevant data on histogram (step S12). Then, the main body control unit 21 stores the time lag data (the newest) which is newly obtained at present time in place of the oldest time lag data (step S13). Thereafter, the main body control unit 21 creates the histogram with the most recent 100 time lag data on the basis of the updated time lag data and updates the histogram (step S14).

After the update processing of the histogram is completed, going back to the flowchart of FIG. 9, the main body control unit 21 determines whether the time lag which is newly calculated at present time (the time lag between the time indicated by the time stamp and the time indicated by the system timer) is shorter than the time which is obtained by adding the "specified time" (i.e. the predetermined set delay which is set by taking the delay times caused by external factors into consideration) to the most frequent time lag (for example, 15 msec in the case of the histogram shown in FIG. 6B) in the updated histogram (step S6).

If it is determined that the time lag which is newly calculated at present time is not shorter than the time which is obtained by adding the "specified time" to the most frequent time lag in the updated histogram (i.e. same or longer) (step S6; NO), the sound output unit 251 is made to emit a predetermined sound according to the sound emission instructing signal immediately (step S7). On the other hand, if it is determined that the time lag which is newly calculate at present time is shorter than the time which is obtained by adding the "specified time" to the most frequent time lag in the updated histogram (step S6; YES), the sound waits for the time period corresponding to the difference between the newly calculated time lag and the time obtained by adding the "specified time" to the most frequent time lag to be emitted (step S8) and the sound output unit 251 is made to emit a predetermined sound according to the sound emission instructing signal after the time period corresponding to the difference between the newly calculated time lag and the time obtained by adding the "specified time" to the most frequent time lag elapses (step S7). In such case, the delay time determined by the main body control unit 21 (the time obtained by adding the "specified time" to the most frequent time lag in the histogram) is added to the sound emission timing indicated in the sound emission instructing signal to emit a predetermined sound from the sound output unit 251.

As described above, according to the sound generation device 1 of the embodiment, a sound emission instructing signal is generated on the basis of the movement of the main body of the stick unit 10, time data is included in the generated sound emission instructing signal and the sound emission instructing signal is sent to the center unit 20 in a wireless manner. Further, the center unit 20 calculates the difference between the time indicated in the time data included in the received sound emission instructing signal and the time when the sound emission instructing signal was received and creates the histogram reflecting the difference, this processing being performed when a sound emission instructing signal is received, and also, the center unit 20 adjusts the sound emission timing based on the sound emission instructing signal on the basis of the histogram and makes the sound output unit 251 emit a predetermined sound on the basis of the sound emission instructing signal at the adjusted timing.

In such way, even when the time indicated by the system timer in the stick unit 10 which is the sender and the time indicated by the system timer in the center unit 20 which is the receiver do not match, the sound emission timing being off due to the time lag can be reduced. Therefore, the time until each sound is emitted after a performer performs the performance operation can be approximately uniform. Thus, even when the performance operation is performed at fast speed as in a case where the hitting surface of a percussion instrument is rolled, the performance can be performed naturally without noticing any strangeness.

Especially in a case where there are a plurality of stick units 10 which are the senders, the performer will sense strangeness if the sound emission timings are different between the operations of the stick units 10. In view of such aspect, by adjusting the sound emission timings by taking the time lags into consideration as in the embodiment, inconvenience such as sounds being emitted with time lag although the performance operations of hitting was performed at the same time can be avoided. Therefore, a natural performance without strangeness can be carried out.

Moreover, in the embodiment, the main body control unit 21 as the sound emission timing adjustment unit determines the delay time the sound emission based on a sound emission instructing signal is to be delayed for each sound emission instructing signal on the basis of the histogram, adds the determined delay time to the sound emission timing indicated in the sound emission instructing signal and makes the sound output unit 251 which is the sound emission unit output a predetermined sound. Therefore, the sound emission timings can be adjusted by taking the most frequent delay time shown in the histogram into consideration. Thus, the sound emission timings being off due to the time lags can be suppressed to the minimum level and a natural performed can be realized.

In the above, the embodiment of the present invention is described. However, the present invention is not limited to the above embodiments and various modifications can be made within the scope of the invention.

For example, in the embodiment, the sound emission timing is adjusted by also taking the delay times caused by external factors into consideration (i.e. by adding the "specified time" to the most frequent value in the histogram), not just the time difference between the times indicated by the system timers in the stick unit 10 (the sender) and the center unit 20 (the receiver). However, it is not required to take the delay times caused by external factors into consideration when adjusting the sound emission timing. The sound emission timing can be adjusted only on the basis of the time lag between the system timers of the signal sender and the signal receiver.

Further, in the embodiment, only the acceleration data measured by the acceleration sensor is exemplified as the motion sensor data obtained by the motion sensor unit 14 as the detection unit. However, the content of the motion sensor data is not limited to this, and angular acceleration may be measured by a gyro and the measured value may be used, for example.

Moreover, in the embodiment, the description is given assuming that rotation around the axis parallel with the stick unit 10 does not occur. However, such rotation may be measured by an angular acceleration sensor or the like to be dealt with.

In the embodiment, the sound generation device 1 includes the motion sensor unit 14 in the stick unit 10 as the detection unit which detects the conditions of the stick unit 10 (performance operator) based on a performer's performance operation (for example, the swung down position, swinging down speed, swinging down angle and the like). However, the detection unit is not limited to the above, and the sound generation device 1 may include a pressure sensor as the motion sensor unit 14, for example, or may use a detection unit using a laser sensor, an ultrasound sensor and various types of sensors which can measure distance and angle in addition to various types of image sensors.

Moreover, in the embodiment, the description is given by taking a virtual drum set D (se FIG. 1B) as an example of a virtual percussion instruments. However, the instrument is not limited to the above, and the present invention can be applied to other instruments such as xylophone which emits sounds by the swinging down movement of the stick units 10.

Further, in the embodiment, the description is given by taking the case where the sound output unit 251 which is the sound emission unit is provided inside the center unit 20 as an example. However, the sound emission unit may be configured separately from the center unit 20. In such case, the sound emission unit and the center unit 20 is to be connected in a wired manner or in a wireless manner and the sound emission unit is to emit the predetermined sounds according to the instructing signals from the center unit 20.

Furthermore, in the embodiment, the case where the stick units 10 are the performance operators is taken as an example. However, the performance operator is not limited to the above. The performance operator may be in a shape other than the stick shape such as a box shape, and for example, the mobile terminals such as mobile phones may be used as performance operators.

The sound generation device 1 is for emitting the sound of a predetermined instrument by performing the performance operation of hitting the space with the performance operator and is not a device where the hitting surface of the instrument is actually hit by the performance operator. Therefore, even in a case where a precision electronic device such as a mobile phone is used as the performance operator, the performance operator will not be damaged.

In the above various embodiments of the present invention are described. However, the scope of the present invention is not limited to the embodiments described above and includes the scope of the invention described in the claims and the equivalents thereof.

What is claimed is:

1. A sound generation device, comprising:

a receiver which receives a sound emission instructing signal which includes time data;

a difference calculator which calculates a difference time between a first timing indicated in the received time data and a second timing when the receiver receives the sound emission instructing signal, each time the sound emission instructing signal is received;

a histogram creator which creates a histogram based on a plurality of difference times calculated previously by the difference calculator, each time a current difference time is calculated by the difference calculator; and a timing controller which controls a timing for sending the received sound emission instructing signal to a sound emission unit based on the current difference time, which is the difference time most recently calculated by the difference calculator, and a highest frequency difference time which has a highest frequency in the created histogram, each time the difference time is calculated, wherein the timing controller includes a determination unit and a sending unit, wherein the determination unit determines whether the current difference time is longer than the highest frequency difference time, wherein, when the determination unit determines that the current difference time is equal to or longer than the highest frequency difference time, the sending unit sends the received sound emission instructing signal to the sound emission unit at the second timing, and wherein, when the determination unit determines that the current difference time is less than the highest frequency difference time, the sending unit sends the received sound emission instructing signal to the sound emission unit at a third timing obtained by adding the highest frequency difference time to the first timing.

2. The sound generation device according to claim 1, further comprising a performance operator which is configured to be held by a performer, wherein the performance operator comprises:

a movement detection unit which detects a movement of a main body of the performance operator, a sound emission instruction generator which generates the sound emission instructing signal based on the movement of the performance operator which is detected by the movement detecting unit, the sound emission instructing signal giving an instruction to emit a sound to the sound emission unit, and a transmitter which sends the sound emission instructing signal generated by the sound emission instruction generator with time data indicating a timing of transmission included in the sound emission instructing signal.

3. The sound generation device according to claim 1, wherein the histogram creator creates the histogram based on the current difference time and the plurality of difference times calculated previously by the difference calculator, each time the current difference time is calculated by the difference calculator.

4. The sound generation device according to claim 1, wherein the sound emission unit is connected to the timing controller.

5. A sound generation method for a sound generation device including a processor and a receiver which receives a sound emission instructing signal which includes time data, the method comprising executing, with the processor, processes comprising:

calculating a difference time between a first timing indicated in the received time data and a second timing when the sound emission instructing signal is received, each time the sound emission instructing signal is received;

creating a histogram based on a plurality of difference times calculated previously, each time a current difference time is calculated;

determining whether the current difference time, which is a most recently calculated difference time, is longer than a highest frequency difference time, which is a difference time having a highest frequency in the created histogram;

when it is determined that the current difference time is equal to or longer than the highest frequency difference time, sending the received sound emission instructing signal to the sound emission unit at the second timing; and when it is determined that the current difference time is less than the highest frequency difference time, sending the received sound emission instructing signal to the sound emission unit at a third timing obtained by adding the highest frequency difference time to the first timing.

6. The sound generation method according to claim 5, wherein the histogram is created based on the current difference time and the plurality of difference times calculated previously, each time the current difference time is calculated.

7. A non-transitory computer readable medium having stored thereon a program that is executable by a computer of a sound generation device including a receiver which receives a sound emission instructing signal which includes time data, the program being executable by the computer to cause the computer to perform functions comprising:

calculating a difference time between a first timing indicated in the received time data and a second timing when the sound emission instructing signal is received, each time the sound emission instructing signal is received;

creating a histogram based on a plurality of difference times calculated previously, each time a current difference time is calculated;

determining whether the current difference time, which is a most recently calculated difference time, is longer than a highest frequency difference time, which is a difference time having a highest frequency in the created histogram;

when it is determined that the current difference time is equal to or longer than the highest frequency difference time, sending the received sound emission instructing signal to the sound emission unit at the second timing; and when it is determined that the current difference time is less than the highest frequency difference time, sending the received sound emission instructing signal to the sound emission unit at a third timing obtained by adding the highest frequency difference time to the first timing.

8. The non-transitory computer readable storage medium according to claim 7, wherein the histogram is created based on the current difference time and the plurality of difference times calculated previously, each time the current difference time is calculated.

* * * * *